United States Patent [19]

Nabeyama et al.

[11] Patent Number: 4,681,459

[45] Date of Patent: Jul. 21, 1987

[54] APPARATUS FOR DISPLAYING ASTROLOGICAL INFORMATION

[75] Inventors: Takatoshi Nabeyama, Tachikawa; Eiichi Sakita, Higashikurume, both of

[73] Assignee: Citizen Watch Co., Ltd., Tokyo, Japan

[21] Appl. No.: 881,034

[22] PCT Filed: Dec. 4, 1985

[86] PCT No.: PCT/JP85/00665

§ 371 Date: Jun. 17, 1986

§ 102(e) Date: Jun. 17, 1986

[87] PCT Pub. No.: WO86/03604

PCT Pub. Date: Jun. 19, 1986

[51] Int. Cl.[4] ..... G04B 19/26; A63F 1/00

[52] U.S. Cl. ..... 368/16; 273/161; 434/106

[58] Field of Search ..... 368/14–20; 434/106; 273/161

[56] References Cited

U.S. PATENT DOCUMENTS 2,518,664 8/1950 Chern ..... 434/106
3,355,822 12/1967 Losey ..... 434/106
4,193,213 3/1980 Suda ..... 273/161

FOREIGN PATENT DOCUMENTS 2005550 4/1979 United Kingdom .

*Primary Examiner*—Vit W. Miska
*Attorney, Agent, or Firm*—Koda and Androlia

[57] ABSTRACT

An apparatus for displaying astrological information has a construction in which a first display element simulating a position on the circumference as the direction of the sun on the ecliptic and a second display element displaying the difference of the sun direction on a birthday with respect to the moon direction, that is, an aspect, or fortune information corresponding to the aspect, are coaxially disposed, and one of these display elements is rotated and set to a position by the aid of moon direction setting means so that the relation of the relative positions between the origin of the second display element and the present sun position on the first display element is substantially in agreement with the difference of directions between the present sun direction and the present moon direction. While the set condition is being kept, the aspect or the fortune information can be stipulated from the display on the second display element corresponding to the sun position on the birthday on the first display element.

4 Claims, 13 Drawing Figures

APPARATUS FOR DISPLAYING ASTROLOGICAL INFORMATION

TECHNICAL FIELD

This invention relates to an apparatus which can easily practise fortune-telling in astrology. More specifically, the present invention relates to a construction of a novel apparatus which can easily determine the fortune which is stipulated on the basis of the difference of angle between the present moon direction and the sun direction on a birthday (which angle difference will be hereinafter referred to as "aspect").

BACKGROUND OF THE ART

Originally, astrology foretells the future or fortune from the positions of the sun, the moon and various planets in the solar system, and an astrological calendar is generally used for calculating angles representing their positions and directions in the heavenly bodies. However, no mechanism has yet been available which can easily determine the positions of various heavenly bodies at a necessary point of time without relying upon the astrological calendar. Incidentally, the term "astrological calendar" means a kind of table which describes the positions of various heavenly bodies relating to the year, month, day and time by numeric figures and which is very complicated to use. In astrology using the astrological calendar, the positions of the heavenly bodies are based upon the noon as the time reference. Therefore, if one wishes to know the present positions, he must make calculation to correct the time. Particularly the moon which rapidly moves in a heavenly sphere has not much been utilized in astrology because the correction is troublesome, although it is known that the moon exerts great influence upon everyday's fortunes.

DISCLOSURE OF INVENTION

In order to eliminate the problem encountered when practising astrology, the present invention contemplates to provide a simple apparatus which transfers information on the directions of the moon and sun to a kind of rotary calculation disk and can easily foretell the future or fortunes without using the astrological calendar and without making any complicated calculation. The present apparatus can be used as an independent calculation disk and can also be accomplished as an additional function to a timepiece. The apparatus of the present invention has a construction in which a first display element simulating a position on a circumference as the direction of the sun on the ecliptic and a second display element describing the difference of the sun direction on a birthday with respect to the moon direction, that is, an aspect, or fortune information corresponding to the aspect are disposed coaxially with each other, at least one of them is rotated and position-set by the aid of moon direction setting means so that the relation of relative positions between the origin of the second display element and the present sun position on the first display element is substantially in agreement with the difference of directions of the present sun and moon in practice, and while this set condition is being kept, the aspect of the fortune can be stipulated from the description of the second display element corresponding to the sun position on the birthday on the first display element.

BEST MODE FOR CARRYING OUT THE INVENTION

Hereinafter, the present invention will be described in detail with reference to preferred embodiments thereof shown in the accompanying drawings.

Embodiment No. 1

Figure 1:
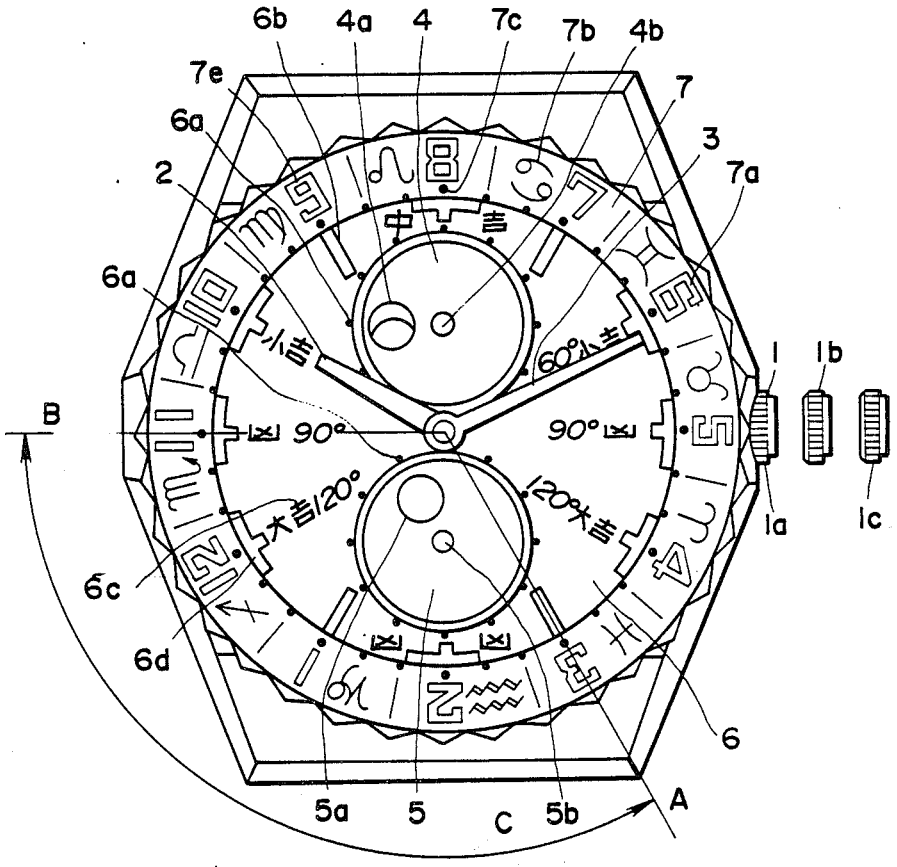
FIG. 1 is a plan view of a first embodiment of the present invention.
Figure 2:
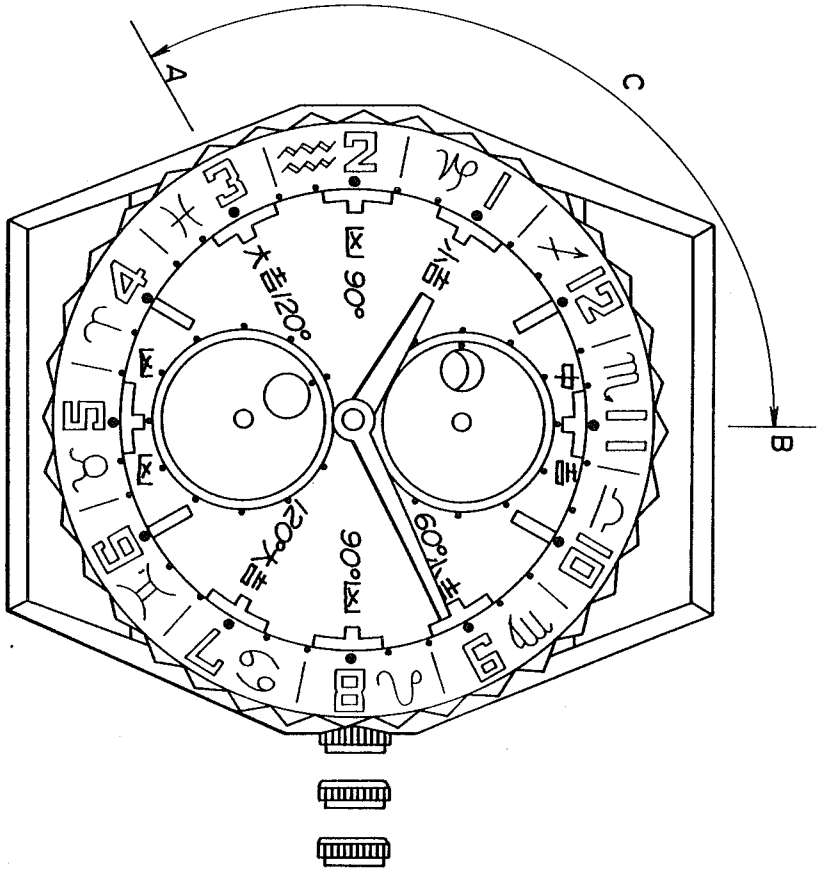
FIG. 2 is a plan view of the first embodiment after its operation is completed.

This embodiment deals with a timepiece having an appearance such as shown in FIGS. 1 or 2. This embodiment is based upon a timepiece having a function of displaying a present direction of the moon and the sun in each of the diurnal motion. Timepieces having the function of displaying the present direction of each of the sun and the moon as the basis to which the mechanism of this embodiment is to be added have already been available as products on the market. They have the appearance obtained by removing a rotary ring 7 from this embodiment and removing also fortune symbols 6*c* from a dial 6. Their internal construction is such that a driving mechanism for a moon dial 4 and a sun dial 5 is put on the movement of an ordinary timepiece on the side of the dial.

The moon dial 4 and the sun dial 5 are driven by a wheel train mechanism which reduces the rotation of an hour wheel, to which an hour hand 2 is pivotally fitted, at suitable gear ratios, resepctively. The moon dial 4 has a speed of revolution of about 0.9548521 round/day in order to be well in synchronism with the diurnal motion of the moon, and the gear ratio is designed so that the sun dial 5 rotates exactly once a day. The wheel train mechanism includes a slip mechanism at its intermediate part so that the practical direction of each heavenly body can be adjusted to the direction of each heavenly body to be displayed on the dial of the timepiece by operating a crown. The timepiece mechanism described above is disclosed in the Applicant's pending Japanese Patent Application No. 138936/1983 (Japanese Patent Laid-Open No. 31081/1985), and the like.

The embodiment provides a timepiece which is simple in mechanism and easy to produce and can easily and rapidly practise divination by adding a rotary ring for reading a sun position and a dial for displaying astrological data on a later-appearing aspect to the timepiece described above.

The sun revolves accurately in one-year period. Therefore, a sun position is irrelevant to how many years ago the birthday was, and the sun position on the birthday returns from today's sun position by the angle obtained by multiplying 360° by the quotinent as the result of division of the number of days between today and the birthday by the number of days of one year. This position is determined by a rotary ring which simulates the orbit of the annual motion of the sun, that is, the ecliptic. The rotary ring is equipped with scales corresponding to 12 months around its periphery. After the today's position on the rotary ring is aligned with the direction of the sun that is read, the direction that corresponds to the birthday of one who practises divination is sought on the same ring. Then, the direction is the sun direction of the birthday. Since this direction and the today's direction of the moon can be easily calculated, the afore-mentioned aspect can be easily read after all.

Next, the origin of the aspect thus read is transferred to the origin on the dial. In other words, one of the ends of an angle representing the aspect on the rotary ring, such as a point corresponding to the present direction of the moon, is brought to the position of 12 o'clock (as the origin of the dial), for example. Since astrological displays representing the good and ill fortunes that correspond to the aspect are put on the dial with the origin described above being the reference, the display corresponding to the other end of the angle representing the aspect on the rotary ring (the position of the birthday in this case) is the his today's fortune, and his fortune can thus be obtained.

Referring to FIG. 1, reference numeral 1 represents a crown which rotates idlely at a normal position, corrects the display of the age of the moon by the rotation in clockwise and counter-clockwise directions at one-stage pull-out position 1*b* and corrects the normal time and the sun at two-stage pull-out position 1*c*. Reference numeral 2 represents an hour hand; 3 is a minute hand; 4 is a moon dial equipped with a moon mark 4*a* for displaying the moon position; 5 is a sun dial equipped with a sun mark 5*a* for displaying the sun position; and 6 is a dial equipped with twelve scales 6*a* that are equidistantly divided at the portions corresponding to the moon dial 4 and the sun dial 5, and with fortune symbols 6*c* and fortune zones 6*d* corresponding to the angles of the aspect with the position of 12 o'clock being the reference.

Reference numeral 7 represents a rotary ring which simulates the ecliptic and can be set to a position of an arbitrary angle of rotation with respect to the dial 6. The circumference of the rotary ring 7 is equally divided into 12 sections, where numerals 7*a* of birth-months from January to December and the respective symbol marks 7*b* of twelve constellations are printed counter-clockwise. 36 scales 7*c* of date are disposed around the inner portion of the dial.

The present moon and sun positions are displayed as shown in the drawing. This display has the following meaning. When one who uses the timepiece faces the south and the surface of the timepiece with the direction of 12 o'clock upward, the moon position is in the direction of a line that connects the center 4*b* of the moon dial 4 to the center of the moon mark 4*a* (on the horizontal line of the east in the drawing), while the sun position is in the direction of a line that connects the center 5*b* of the sun dial 5 to the center of the sun mark 5*a* (at about 60° in the direction of the culmination from the borizontal line of the east in the drawing). (By way of precaution, the difference of the positions between the sun and the moon is 60° .)

Next, astrology can be practised in the following way.

A typical case where today is September 1st, around 10:10 a.m. and the user's birthday is March 1st will be described with reference to FIG. 1.

First of all, the astrological sun position is determined. That is, the position of the sun mark 5*a* of the sun dial 5 in FIG. 1 is confirmed to be in the direction of 11 o'clock by the scale 6*a* of the dial 6 corresponding to the sun dial 5, and then the rotary rmg is rotated clockwise or counter-clockwise and set to the scale line of 11 o'clock of the hour scale 6*b* of the dial 6 so that the position of the scale 7*e* of the rotary ring 7 representing September 1st points the direction of 11 o'clock whose position has been confirmed by the sun dial 5 in the manner described above. Next, while this set condition is being kept, the position of the birthday March 1st is sought on the rotary ring 7 to find that it is in the direction of the scale of 5 o'clock of the hour scale 6*b* of the dial 6. This means the astrological sun position A (on the birthday).

Next, the astrological moon position is determined. In other words, the position of the moon mark 4*a* of the moon dial 4 in FIG. 1 is confirmed to be in the direction of 9 o'clock by the scale 6*a* of the dial 6 corresponding to the moon dial 4. Next, while the rotary ring 7 is kept set, the direction of 9 o'clock whose position has thus been confirmed by the moon dial 4 is moved parallel to the position of 9 o'clock of the hour scale 6*b* of the dial 6, and this is the astrological (present) moon position B.

Next, the astrological aspect is determined. In other words, since the aspect represents a relative angle of the astrological sun position A to the astrological moon position B, the relative angle C between the astrological sun position A and the astrological moon position B, that is, 120°, is today's astrological aspect.

One's fortune is foretold by the aspect. The fortune is broadly classified as follows.

TABLE 1

| | | |
|---|---|---|
| angle of aspect | 0° | medium luck |
| (range ± 8°) | 60° | small luck |
| | 90° | ill luck |
| | 120° | great luck |
| | 180° | ill luck |

The good and ill luck can be read from the direction of November 1st and from the scale 7*c* by confirming the astrological moon position B on the rotary ring 7. The rotary ring 7 is rotated and set so that the scale 7*c* of November 1st read from the rotary ring 7 comes to the position of 12 o'clock on the dial 6 as shown in FIG. 2, and while the rotary ring 7 is kept set, the position of lst March as the birthday is read on the rotary ring, whereby the fortune symbols 6*c* on the dial 6 represents the great luck at the angle of aspect of 120° . Thus, one can quickly foretell his future.

It is very convenient if the table of the aspect is printed at part of the cover or band of the timepiece.

As described above, this embodiment can be applied to the astrology by merely adding the rotary ring for astrology to the timepiece equipped with the age of the moon and the sun display and adding the fortune symbols onto the dial. Thus, the timepiece capable of practising today's fortune can be produced economically.

Embodiment No. 2

The second embodiment of the present invention will be described with reference to FIGS. 3 to 5.

This embodiment deals with a timepiece for practising astrology by substantially the same method as in the first embodiment, but is somewhat different from the first embodiment in that the astrological table is separated from the timepiece main body and contrivance is made in order to more easily read the aspect. The timepiece mechanism as the basis is substantially the same as one that is used in the first embodiment, and hence the operation of the components exhibiting the same operations will be omitted (components 1 to 6).

Figure 3:
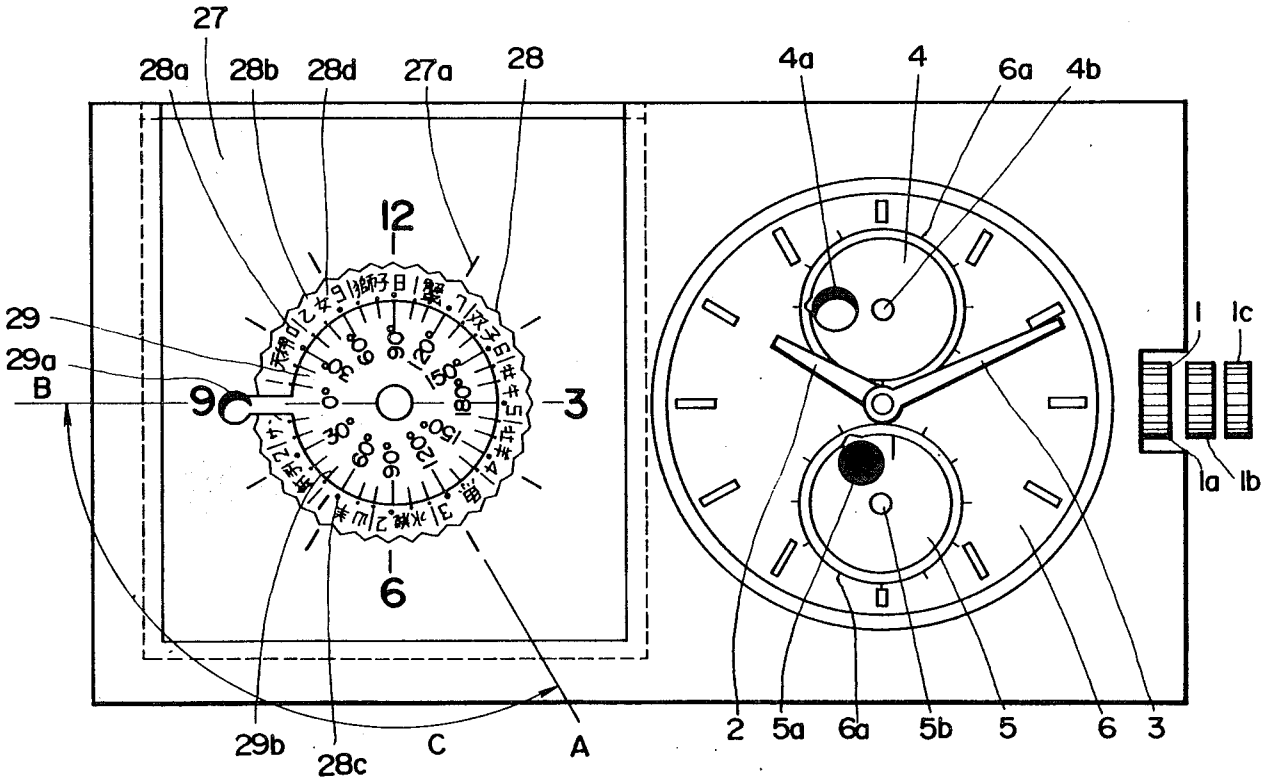
FIG. 3 is a plan view of a second embodiment of the present invention.

In FIG. 3, reference numeral 27 represents an astrological dial, which is equipped with hour scales 27*a* as the dial of a timepiece. Reference numeral 28 represents an ecliptic dial, which can be set manually to an arbitrary angle of rotation with respect to the astrological dial 27. The circumference of the ecliptic dial 28 is divided into 12 equal sections, and the numerals 28 of the birth-months from January to December and the characters 28*b* of the twelve constellations are printed counter-clockwise. In addition, day scales 28*c* that are divided equidistantly into 36 sections are disposed around the inner portion. Reference numeral 29 represents a moon position display plate, which is equipped with a moon mark 29*a* for astrology at one position. Angle scales 29*b* are disposed on this moon position display plate 29 on the right and left within the range of 180° with the position of the moon mark 29*a* as the reference. The plate 29 is fitted pivotally and concentrically with the ecliptic plate 28 and can be set manually in an artibrary direction.

Figure 4:
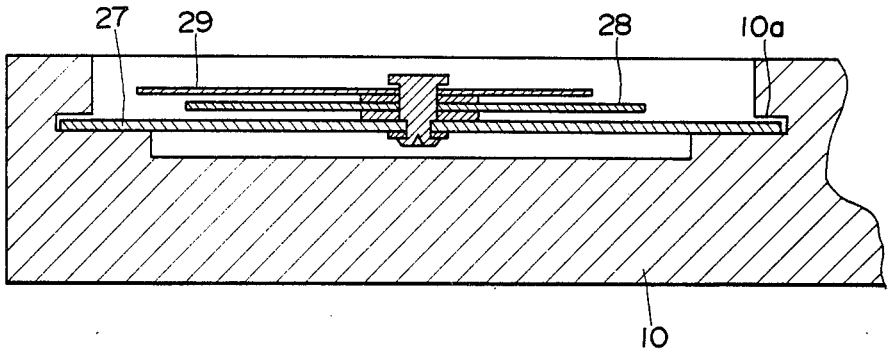
FIG. 4 is a sectional view of an astrological read disk portion of the second embodiment.
Figure 5:
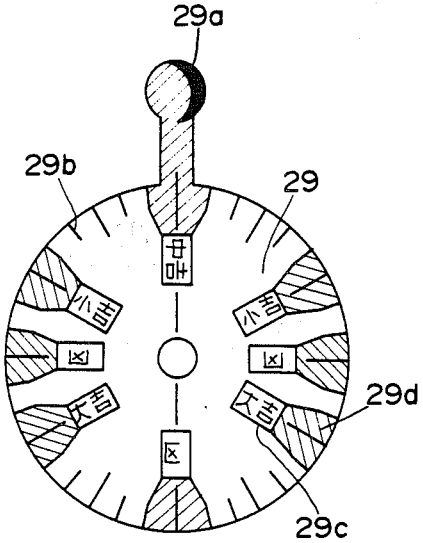
FIG. 5 is a plan view of a modified example of a moon position display plate of the second embodiment.

The astrological dial 27 is idlely fitted into the groove 10*a* of the timepiece case 10 as shown in FIG. 4 and can be freely taken out from the case 10.

A method of practising astrology in the case where today is September 1st, about 10:10 a.m. and the user's birthday is March 1st, will be described.

First of all, the astrological sun position is determined. In other words, the present position of the sun mark 5*a* of the sun dial 5 in FIG. 1 is confirmed to be in the direction of 11 o'clock by the scale 6*a* of the dial 6 corresponding to the sun dial 5, and then the ecliptic plate 28 is rotated to clockwise or counter-clockwise and the scale 27*a* of the astrological dial 27 is set to the position of the scale of 11 o'clock of the hour dial 27*a* so that the position of the scale 28*d* of September 1st points the direction of 11 o'clock whose position is confirmed by the sun dial 5.

While the set condition is kept as such, the position of the birthday March 1st is sought on the ecliptic plate 28, whereby it is confirmed in the direction of the scale of 5 o'clock of the hour scale 27 of the astrological dial 27. This is the astrological sun position A (on the birthday). Next, the present moon position is transferred to the astrological dial 27.

In other words, the position of the moon mark 4*a* of the moon dial 4 in FIG. 3 is confirmed to be in the direction of 9 o'clock by the scale 6*a* of the dial 5 corresponding to the moon dial 4, and then the moon position display plate 29 is rotated clockwise or counter-clockwise and setting is made so that the astrological moon mark 29*a* of the moon position display plate 29 is in alignment with the scale of 9 o'clock of the hour dial 27*a* of the astrological dial 27. This is the astrological (present) moon position B.

Next, the astrological aspcct is determined. In FIG. 3, the relative angle C between the astrological sun position A and the astrological moon position B, that is, 120°, is the astrological today's aspect, which foretells the fortune of the user.

Thus, the user's fortune is found to be great luck from the same table between the aspect and the fortune (Table 1) that is used in Embodiment No. 1. If the table between the aspect and the fortune is printed on the side, upper surface or back of the timepiece or at a part of the astrological read plate 8, it can be used conveniently. If direct fortune information 29*c* is put as shown in a modified embodiment of the moon position display plate shown in FIG. 5, the fortune can be read directly and more conveniently.

Embodiment No. 3

A third embodiment of the present invention applied to a wrist watch will be described with reference to FIGS. 6 to 8. In this embodiment, the difference of the present moon direction with respect to the present sun can be always displayed automatically when initial set is made once. Therefore, the user can immediately read the aspect corresponding to his own birthday or his fortune without touching at all the watch. Its principle will be described. The sun direction is determined by the deposition where the sun is positioned on the ecliptic on the so-called "celestial sphere" having each fixed star fixed on the surface thereof as viewed from the earth.

The moon position is determined by the position where the moon is positioned on the moon's path. The period in which the sun revolves round the ecliptic is one year and the period in which the moon revolves round the moon's path is one tropical month, which is about 27.3216 days. Both the ecliptic plane and the plane of the moon's path are a little bit inclined, but their angles of inclination is limited so that they can be regarded as existing on the same plane because the allowance of direction used in astrology is great. Needless to say, the ecliptic and the moon's path are concentric circles. The sun direction at an arbitrary point on the ecliptic can be easily determined by stipulating the month and day because the period of revolution is accurately one year. On the basis of the principle described above, in the present invention, the sun direction on the birthday is read from the display plate embodying the ecliptic, and today's moon direction is stipulated by another display plate which is concentric with the display plate described above, rotates relatively in the period of one tropical month and embodies the moon's path so that the aspect or the fortune information such as good and ill luck can be directly read from the relation of positions of these two display plates.

In the construction of the present invention, displays of sun directions in one year period are put around the entire circumference of a first display plate of a timepiece having a time display functional portion, fortune information is put on a second display plate and the first and second display plates rotate relatively in a revolution period approximate to that of the moon, i.e. 27.3216 days (one tropical month).

The display plate representing the ecliptic is equipped with the month or month and day scales covering 12 months around the circumference of the plate surface, and a sun direction of a certain month and day viewed from the center of the display plate is regarded as being in agreement with the direction of the scale of that month and day. A moon mark is put at one position of the second display plate which rotates relatively to the former and embodies the moon's path and the initial position is adjusted so that this moon mark always indicates the direction of the present month (with respect to the first display plate fixed to the ecliptic surface). Then, the moon mark corresponds to the present month direction while the sun direction of the birthday does to the position of the birthday on the first display plate. Therefore, the aspect can be directly read as the angle between them. If fortune displays corresponding to the aspect with the moon mark being the reference are disposed on the second display plate, the fortune at the position of birthday can be read directly as the today's fortune.

Figure 6:
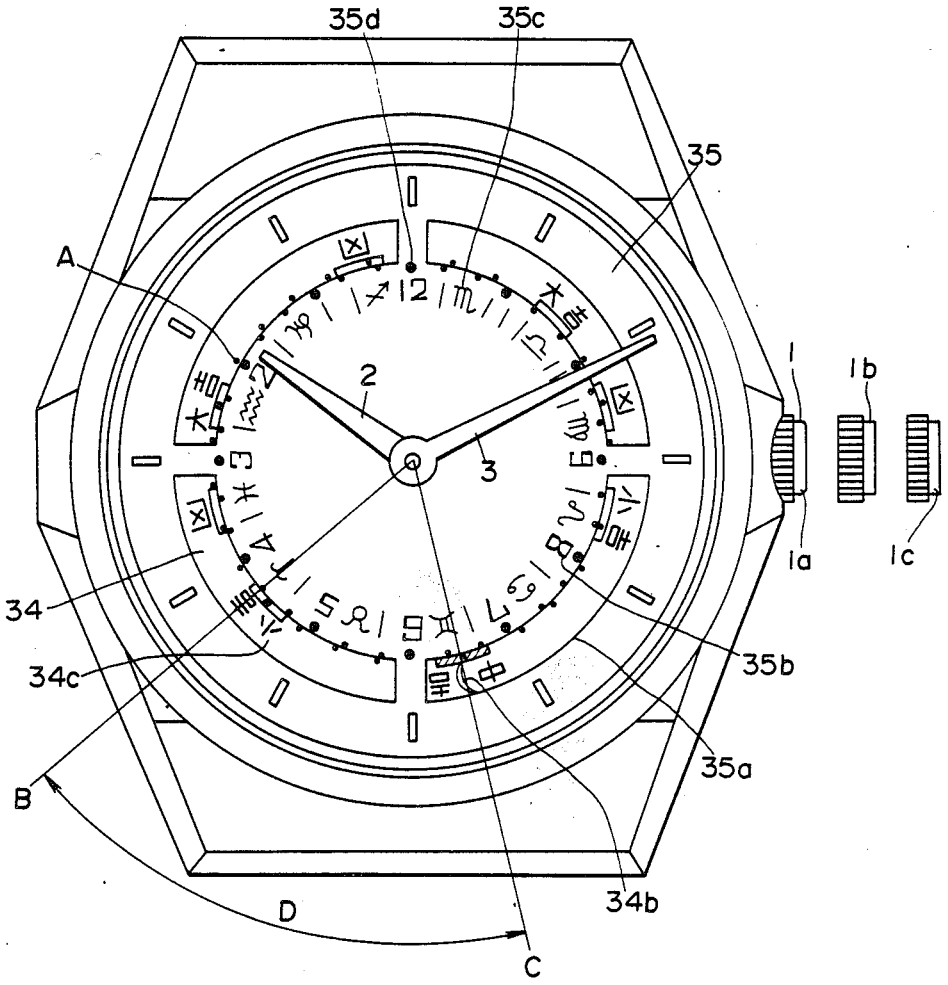
FIG. 6 is a plan view of a third embodiment.
Figure 7:
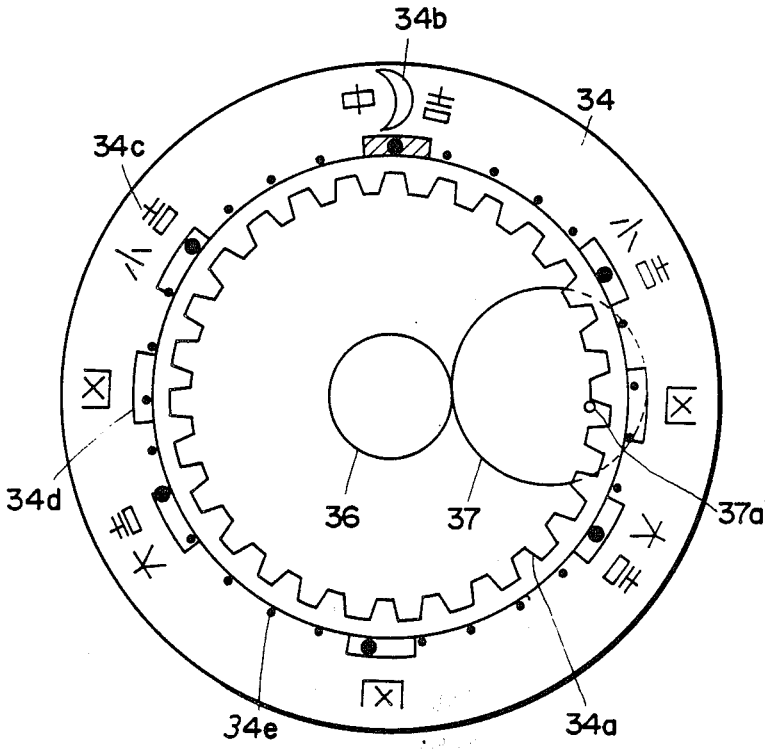
FIG. 7 is a plan view of a fortune telling plate of the third embodiment.

FIG. 6 is a plan view of the wrist watch equipped with an astrological display function, and FIG. 7 is a plan view of a fortune telling plate used in the watch shown in FIG. 6. FIG. 8 shows a modified example of the display in this embodiment.

Reference numeral 1 represents a crown, which rotates idlely at a normal position, corrects the fortune telling plate at one-stage pull-out position and corrects normal time at two-stage pull-out position. Reference numeral 2 represents an hour hand, 3 is a minute hand, and 34 is the fortune telling plate as a second display plate which represents the moon position on the moon's path. Inner gears 34*a* divided into 27 equal parts are disposed at the inner portion display plate, and a moon mark 34*b* for astrology is disposed at one position. Fortune characters 34*c* and fortune zones 34*d* are disposed on the right and left with the moon mark 34*b* as the reference, and 29.5 equally divided moon age scales 34*e* are further disposed in a counter-clockwise direction. Reference numeral 35 represents a character plate as a first display plate representing the sun position on the ecliptic, which is equipped with a window 35*a* for viewing the astrological moon mark 34*b*, the fortune characters 34*c* and the fortune zones 34*d* therethrough. The inside circular rim of the window 35*a* is divided into 12 equal sections, and the numerals 35*b* of the birthmonths from January to December and 12 constellation symbol marks 35*c* of the birthmonths are put counterclockwise. Rough scales 35*d* that are divided into 36 equal sections for every 10 days are disposed outside the symbol marks 35*c*. Reference numeral 36 represents an hour wheel to which the hour hand 2 is fitted. Reference numeral 37 represents a driving wheel which turns the fortune telling plate 34 by every inner gear 34*a* per day.

In connection with the display mechanism and display correction mechanism of the fortune telling plate 34, the present invention merely changes the rotation of a dial in an ordinary watch equipped with date display function to the reverse direction, and changes the number of teeth from 31 to 27. Since the construction is well known in the art, the explanation will be omitted.

Next, the operation of the watch will be described.

A typical example where the date of purchase of the watch is February 1, 1985 will be described.

First of all, today's age of the moon, i.e., February 1st, is confirmed. The age of the moon is put in the column of weather forecast, sports or leisure of ordinary newspaper. The age of the moon at noon of February 1st, i.e. 11.0, is confirmed. Then, the crown 1 shown in FIG. 6 is pulled out from the ordinary position 1*a* to the two-stage pull-out position 1*c* shown in FIG. 6 so as to adjust the hand by an ordinary watch manipulation. Whether the time is the forenoon or the afternoon is confirmed from the movement of the fortune telling plate 34 to adjust the time. (The time at which the fortune telling plate 34 operates is adjusted to around noon.)

Next, the eleventh scale 34*e* of the age of the moon is counted clockwise with the position of the moon mark 34*a* being 0 on the fortune telling plate 34, and the crown 1 is returned from the two-stage pull-out position 1*c* to the one-stage pull-out position 1*b*. Then, while rotating the crown 1, the scale which is the closest to today's scale, i.e. February 1st, of the data scales 35*d* of the dial is adjusted to 11 of the scale 34*e* of the age of the moon of the foretune telling plate 34. This position is today's sun position A at noon.

Next, the crown 1 is returned to the ordinary position. Thus, the adjustment of each hand and correction of the foretune telling plate are completed.

Next, the application to the astrology will be described.

A typical in which today is February 1st and the birthday of the user is April 10th will be described with reference to FIG. 6.

First of all, the astrological sun position is determined. In other words, the scale of April 10th of the date scales 35*d* on the dial 35 shown in FIG. 1 is the astrological sun position B (on the birthday).

Next, the astrological sun position is determined. In other words, the position of the moon mark 34*b* of the fortune telling plate 34 in FIG. 6 is the astrological (present) moon position C.

Then, the astrological aspect is determined. The aspect represents a relative angle D between the astrological sun position B and the astrological moon position C, and the relative angle of about 60° in FIG. 6 is the astrological today's aspect. Therefore, today's fortune can be read as small luck by the fortune characters 34*c* of the fortune telling plate 34. The relation between the aspect and the fortunes is the same as Table 1 explained in the Embodiment No. 1.

The afore-mentioned age of the moon, that is read from the newspaper, is of the age around the noon. If the time when the astrology is practised is around 10:00 a.m., the difference of directions between the present moon and sun positions viewed from the earth is 0.5°/hour in terms of the moon position, that is, 1°/2 hours. In addition, one turn of the fortune telling plate 34 is adjusted to 27 days while the revolution period of the moon (one tropical month) is 27.3216 days. Therefore, there is a difference of about 0.3 days or about 4° in terms of angle. This means deviation of about 1 day/3 turns of the fortune telling plate 34, and hence this plate 34 may be corrected by about 1 day at this time.

In order to produce a wrist watch having the fortune telling plate 34 which needs not be corrected throughout a year, the relation ratio from the hour wheel 36 to the fortune telling plate driving wheel 37 is arranged in the combination showin in Table 2 so as to rotate the fortune telling plate 34 by the fortune telling plate driving pin 37*a*. Furthermore, it is possible to rotate the fortune telling plate at a uniform speed by a reduction gear mechanism consisting only of gears.

TABLE 2

| number of gears of fortune telling plate 34 | number of gears of hour wheel 36 | number of gears of fortune telling plate driving wheel 37 | number of days of one turn of fortune telling plate 34 |
|---|---|---|---|
| 27 | 41 | 83 | 27.33 |
| 28 | 41 | 80 | 27.32 |
| 29 | 26 | 49 | 27.33 |
| 30 | 34 | 62 | 27.35 |
| 31 | 21 | 37 | 27.31 |

Figure 8:
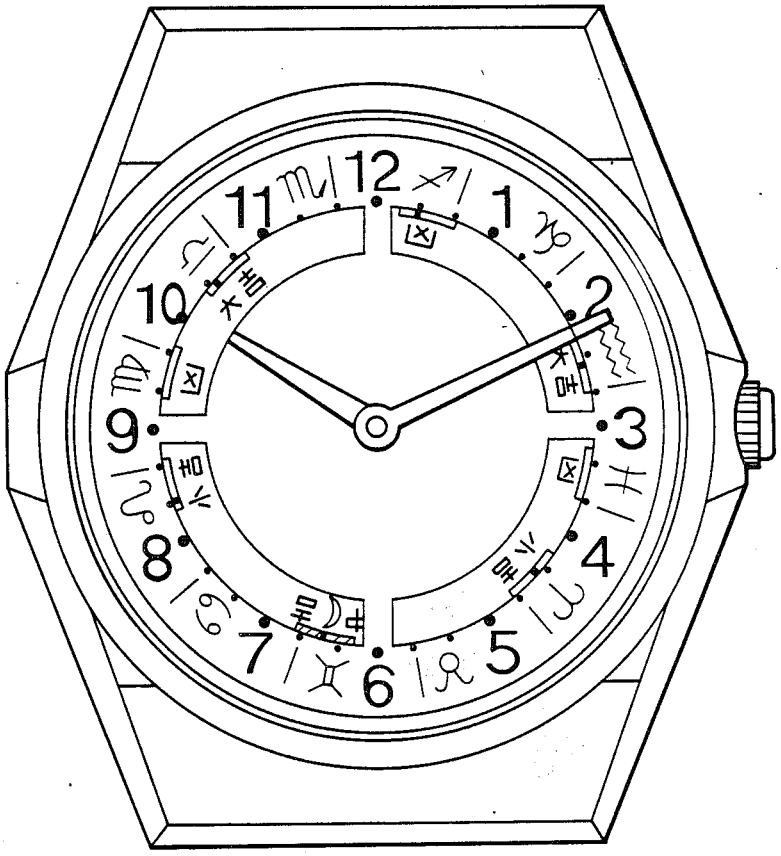
FIG. 8 is a plan view of a modified embodiment of the third embodiment.

FIG. 8 relates to a modified embodiment of this embodiment and shows the appearance of the fortune telling plate which rotates clockwise. The explanation of the operation of this embodiment will be omitted because it is the same as the operation of the embodiment described in detail with reference to FIG. 6.

Although the moon display is movable in the embodiment described above, the sun display plate may be movable, on the contrary, by assuming that the timepiece is fixed with respect to the moon on the moon's path.

Embodiment No. 4

The fourth embodiment of the invention, which is applied to a wrist watch, will be described with reference to FIGS. 9 and 10. The moon waxes and wanes and its condition is solely dependent upon the difference of directions between the sun and the moon as viewed from the earth. On the basis of this principle, a rotary member which rotates in the same period as waxing and waning is used to first determine today's difference of directions, and then the aspect on the birthday is easily determined by use of a rotary ring which simulates the ecliptic.

More definitely, a moon position display plate is rotated by a timepiece movement in a period which is substantially equal to a mean waxing and waning period of 29.53 days. The angle of rotation of one point (moon mark) of this display plate from its start position when the age of the moon is zero represents as such the present angle between the sun and the moon. Therefore, when today's position of the rotary ring which simulates the ecliptic and has the same axis of rotation is manually adjusted to the start position described above, the angle between the position of the birthday on the rotary ring and the moon mark represents the aspect. In other words, if the aspect or fortune information are put on the moon position display plate with the moon mark being the reference, the aspect or the fortunes can be read immediately. (The age of the moon is expressed by a numeric value of the time lapsed from the instant of a new moon in the unit of day.)

Figure 9:
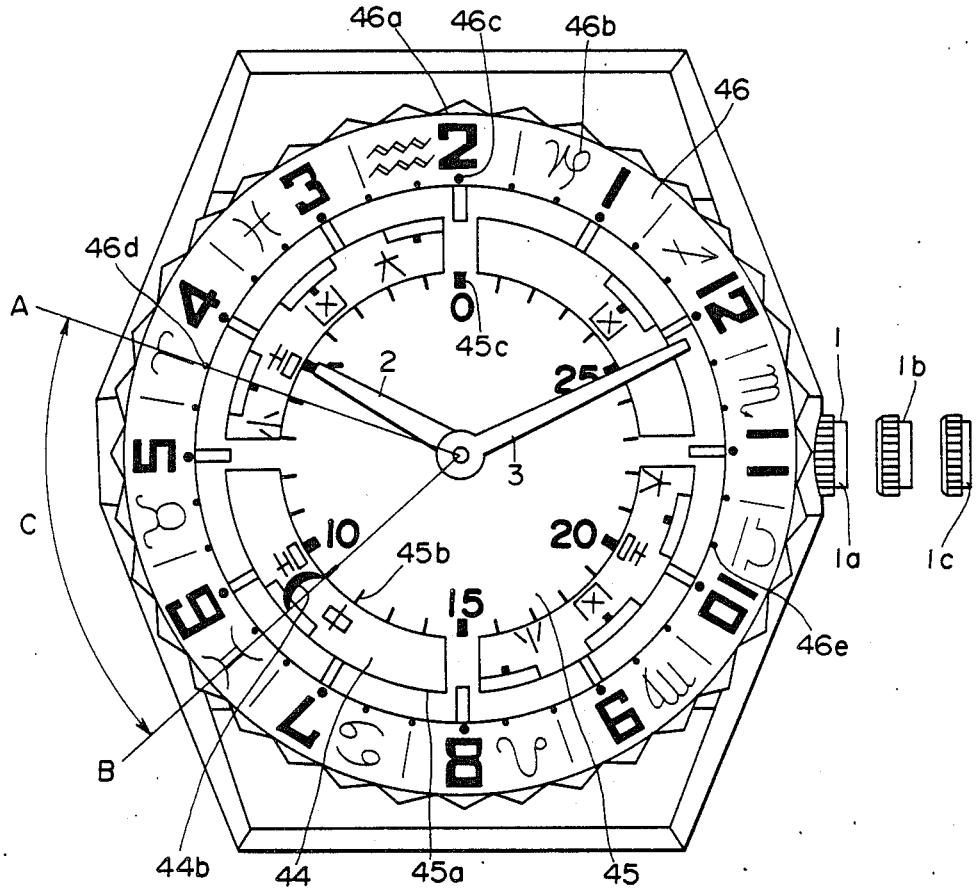
FIG. 9 is a plan view of a fourth embodiment.
Figure 10:
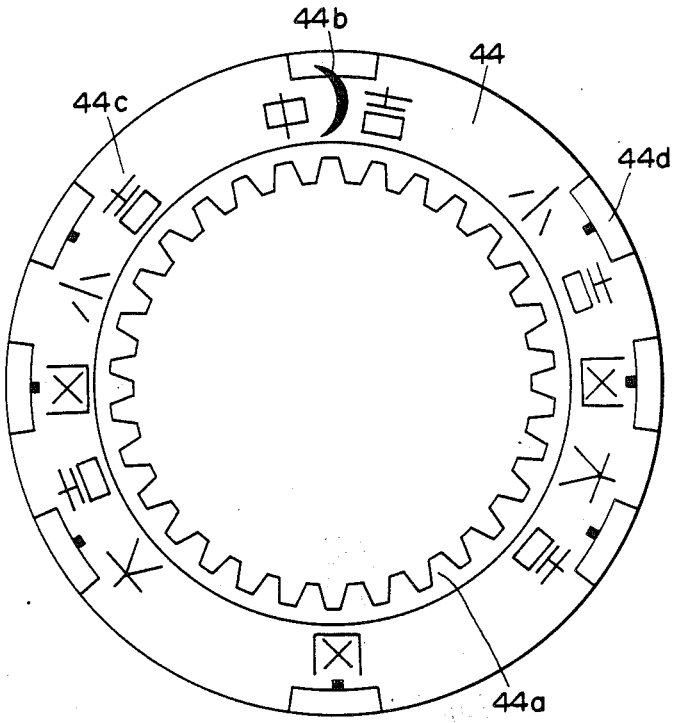
FIG. 10 is a plan view of a moon position display plate used in the fourth embodiment.

In FIGS. 9 and 10, reference numeral 1 represents a crown, which rotates idlely at a normal position 1*a*, corrects the moon position display at one-stage pull-out position and corrects the ordinary time at two-stage pull-out position. Reference numeral 2 represents an hour hand, 3 is a minute hand and 44 is a moon position display plate, which is equipped at its inner portion with 30 equally divided inner gears 44*a*, with one mark 44*b* for astrology, and with fortune characters 44*c* and fortune zones 44*d* on the right and left of the moon mark 44*b* as the reference. Reference numeral 45 represents a dial, which is equipped with a window 45*a* for viewing the astrological moon mark 44*b*, the fortune characters 44*c* and the fortune zones 44*d* therethrough, and with 30 equally divided scales 45*b* for the age of the moon at its inner portion. Reference numeral 46 represents a rotary ring, which can be set to a position of an arbitrary angle with respect to the dial 45. The circumference of the rotary ring 46 is divided into 12 equal sections, and numerals 46*a* of birthmonths from January to December and 12 constellation symbol marks 46*b* for the birthmonths are printed counter-clockwise, and 36 equally divided rough scales 46*c* for 10 days are put around its inner portion.

Incidentally, the display mechanism and display correction mechanism of the moon position display plate 44 are formed by merely changing the number of gears (31) of the date dial of an ordinary timepiece equipped with date display to 30 and using the date dial as the moon position display plate. These mechanisms per se are well known in the art and the explanation will be therefore omitted. The number of gears of 30 is selected because it is the closest to the period of the age of the moon, i.e., 29.53 days. If the number of gears of each of the hour wheel, date transmission wheel, date wheel and date dial (moon position display plate) is selected once again, a mean period of rotation which is closer to 29.53 days can of course be obtained (since it is not used for the date display, intermittent rotation of the moon position display plate may occur without any problem in the daytime.)

Next, the operation will be described.

A typical example where the date of purchase of the wrist watch is Feb. 1, 1985 will be described.

First of all, the age of the moon is confirmed by newspaper. It is generally described in the column of weather forecast, sports or leisure. After the age of the moon of 11.0 at noon of February 1st is confirmed, the crown is pulled up from the normal position 1*a* to the two-stage pull-out position 1*c* so as to adjust the hands by normal manipulation. At this time, the time is adjusted while confirming the forenoon or afternoon by the movement of the moon position display plate 44. (The finish of operation of the moon position display plate 44 is set to about 0:00 a.m.).

Next, the crown 1 is returned from the two-stage pull-out position l*c* to the one-stage pull-out position l*b* and rotated so that the moon mark 44*b* of the moon position display plate 44 comes to the position of 11 of the scale 45*b* for the age of the moon of the dial 45 as shown in FIG. 9, and thereafter the crown 1 is returned from the one-stage pull-out position to the normal position. Thus, adjustment of each hand and correction of the age of the moon are completed.

Next, the application to astrology will be explained.

In FIG. 9, a typical case where today is February 1st, around 10:10 a.m. and the user's birthday is April 10th will be described.

First of all, the astrological sun position is determined. In other words, In FIG. 9, the rotary ring is rotated clockwise or counter-clockwise and is set so that the scale 46*c* of the February 1st of the rotary ring 46 comes to the position of the age of the moon of 0 day of the scale 45*b* for the moon age of the dial 45. While this set state is being kept as such, the scale 6*d*of April 10th, that is, the birthday, is read on the rotary ring 46. This is the astrological sun position A (on the birthday). Next, the astrological moon position is determined. Namely, in FIG. 9, the position of the moon mark 44*b* of the moon position display plate 44 is the astrological (present) moon position B. Next, the aspect is determined. In FIG. 9, the relative angle C between the astrological sun position A and the astrological moon position B, i.e. 60°, is today's astrological aspect. Then, today's fortune is foretold as small luck by the fortune characters 4c of the moon age display plate. The relation between the aspect and the fortune is the same as Table 1.

The age of the moon confirmed from the newspaper is the age of the moon at noon. If the time at which astrology is practised is around 10:00 a.m., the difference of directions between the present moon position and the present sun position as viewed at present has deviation of 0.5° /hour at the moon position or 1° for two hours. Since one turn of the moon age display plate 4 is 30 days, there is deviation of from 0.2° to 6° with respect to the period of the moon age, i.e., 29.53 days. However, the position error of the moon position display plate 4 can be substantially neglected.

For reference, another example where today is February 1st and the user's birthday is October 10th will be described. His fortune is foretold as great luck by the moon position display plate 4 at the scale 6e of October 10th of the rotary ring 6.

Embodiment No. 5

The fifth embodiment of the present invention will be described with reference to FIGS. 11 to 13.

This embodiment consists of a plurality of rotary plates that are coaxially combined with one another. Unlike the foregoing embodiments, it is not driven by a timepiece mechanism. As described in the Embodiment No. 4, however, if the age of the moon is known, today's position relation between the sun and the moon can be known. [The difference of directions between the present moon position and the present sun position as viewed from the earth is substantially equal to an angle obtained by multiplying by 360° the quotient as a result of division of the present moon age by the number of days (approx. 29.53) of the mean synodic month.] If the numeric value of the age of the moon is manually set by utilizing the fact described above, the aspect or the fortune can be directly read. Thus, this embodiment provides a kind of an easy-to-use calculation disk based on the concept described above.

Figure 11:
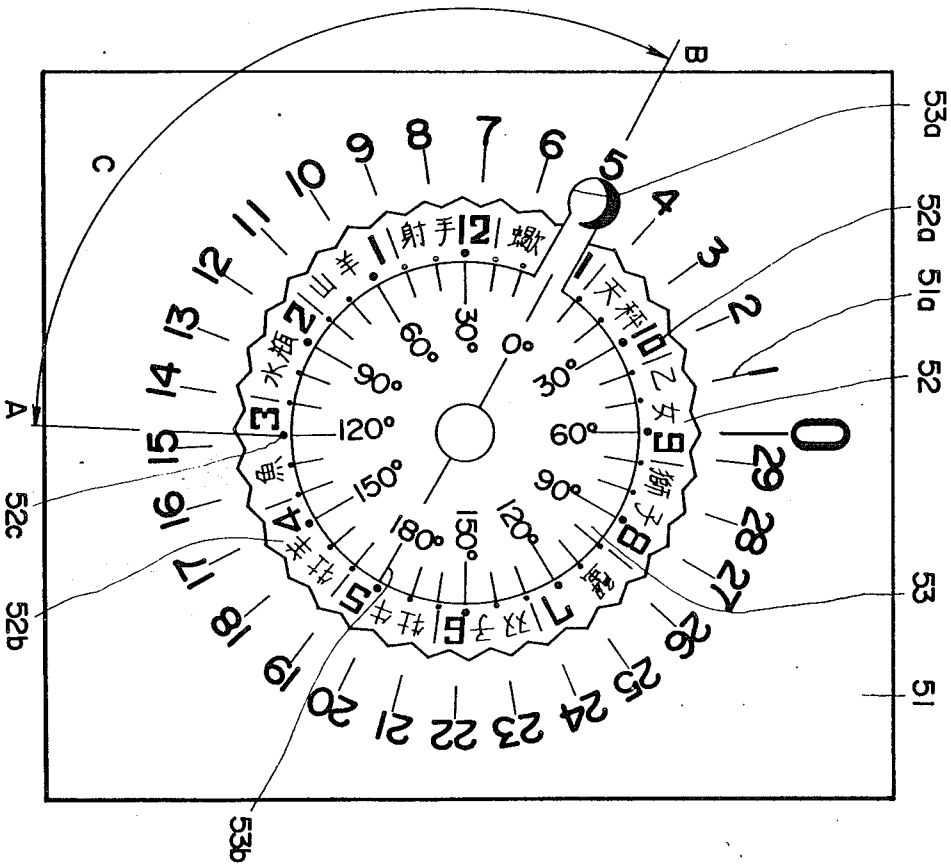
FIG. 11 is a plan view of a fifth embodiment.
Figure 12:
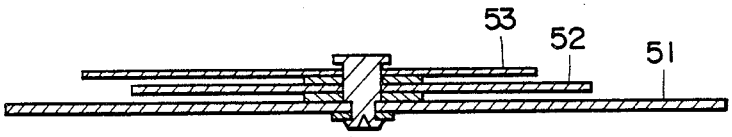
FIG. 12 is a sectional view of the fifth embodiment.

In FIGS. 11 and 12, reference numeral 51 represents a moon age plate. The circumference of this plate 51 is divided into 29.5 equal sections and moon age scales 51a from 0 to 29 as one synodic month are printed counter-clockwise. (It is possible to depict the shapes of the moon, that can be seen at the moon age represented by the moon age numerals, in place of, or in parallel with, the moon age numerals.)

Reference numeral 52 represents a moon display plate, which can be set manually to the position of an arbitrary angle of rotation with respect to the moon age plate 51. Its circumference is divided into 12 equal sections, and numerals 52a of birthmonths from January to December and 12 characters 52b of the constellation of the birthmonths are printed counter-clockwise, and 36 equally divided rough scales 52c for every 10 days are disposed at the inner portion. Reference numeral 53 represents a moon position display plate, which is equipped with an astrological moon mark 53a at one position and with angle display scales 53b on the right and left of the moon mark 53a within the range of 180°. This display plate 53 is coaxially fitted to the moon display plate 52 and can be set manually in an arbitrary direction.

Next, the application to astrology will be explained.

A typical case where today is September 1st, around noon, and the user's birthday is March 1st will be described.

First of all, the astrological sun position is determined. Namely, in FIG. 11, the moon display plate 52 is rotated clockwise or counter-clockwise and is set so that the scale 52c of September 1st of the moon display plate 52 comes to the 0 scale line of the moon age scale 51a of the moon age plate 51. Next, while this set condiction is being kept as such, the scale 52c of the birthday, i.e. March 1st, is read on the moon display plate 52. This is the astrological sun position A (on the birthday). Next, the astrological moon position is determined. This can be confirmed from the column of weather forecast, sports or leisure of ordinary newspaper. First, today's (September 1st) moon age at noon, that is, 5.3, is confirmed. Then, the moon mark 53a of the moon position display plate 53 is rotated clockwise or counter-clockwise and set so that it comes to the scale of 5.3 of the moon age scale 51a of the moon age plate 51. This is the astrological moon position B. Next, the astrological aspect is determined. In other words, the relative angle C between the astrological sun position A and the astrological moon position B, that is, 120°, is today's astrological aspect. The fortune corresponding to this aspect is found as great luck from Table 1.

Figure 13:
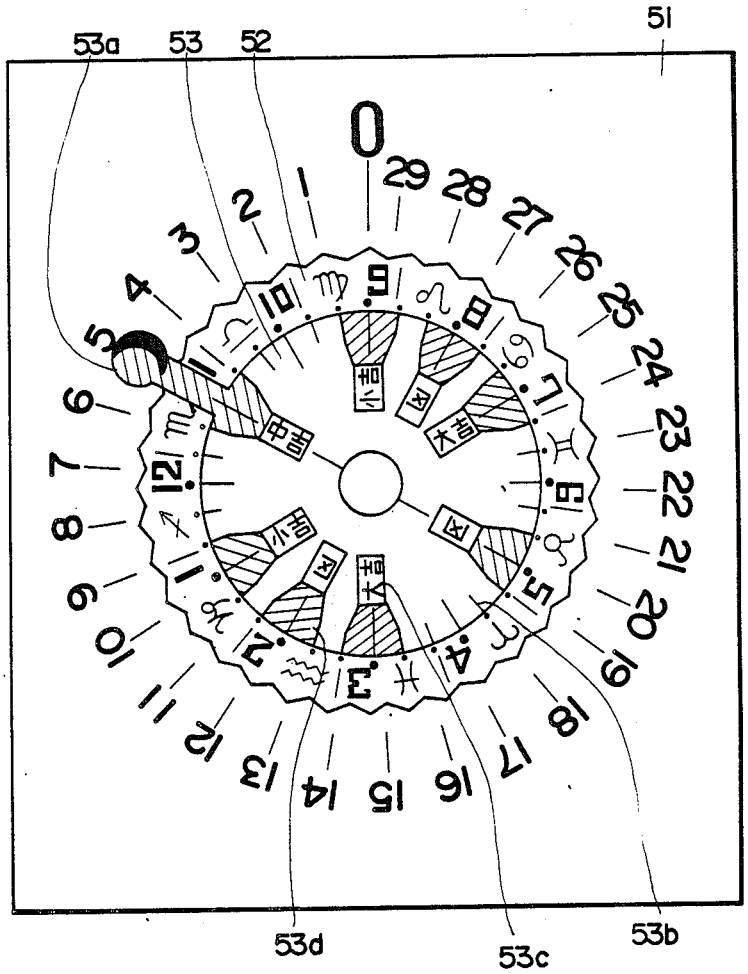
FIG. 13 shows a modified embodiment of the fifth embodiment.

If the fortune characters 53c and the fortune zones 53d are directly printed in such a manner as to correspond to the angles of the aspect as in the moon position display plate 53 of a modified embodiment shown in FIG. 13 in place of Table 1, the arrangement is suitable for a person with a short memory. The afore-mentioned age of the moon confirmed from the newspaper is the moon age at noon. If the time of astrology is around 3:00 p.m., the difference of directions between the present moon position and the present sun position as viewed from the earth is about 0.5°/hour, that is, 1.5° for three hours. Therefore, the moon display plate 52 and the moon position display plate 3 need not be corrected.

As described above, various modifications can be present in the present invention.

Industrial Applicability

As can be understood clearly from the description given above, the present invention provides for the first time an apparatus which can easily display the astrological fortunes by a sequence that everyone can easily understand, without the necessity of complicated calculation using the astrological calendar. Therefore, astrology is now opened for people in general from the hands of fortune-tellers. The apparatus of the present invention can be used as a single product and when assembled into a timepiece, a product having high compatibility with the timepiece mechanism can be obtained. Being compact, the apparatus of the present invention is of course suitable for private use. If the apparatus of the invention is produced in a large scale and disposed at a public space, many people can read the fortunes corresponding to their birthdays. Being simple in construction, the present apparatus is suitable for mass-production and economical. Therefore, the present invention provides high industrial applicability.

What is claimed is:

1. An apparatus for displaying astrological information comprising:

a first display means for displaying information which represents the direction of the sun throughout of the year with respect to a center axis of a watch display surface and is put at regular intervals on the circumference of a circle enclosing said center axis;

a second display means for displaying information which represents the angle difference of directions between the present moon and the sun on a birthday, that is, an aspect, or a fortune corresponding to said aspect is put on the circumference of a circle enclosing said center axis, said second display means capable of rotating around said center axis relatively to said first display means; and auxiliary setting means engaging an hour wheel, including train wheels rotating at a predetermined speed, and capable of setting the direction of at least one of the moon and the sun to desired directions by operating a crown.

2. The apparatus for displaying astrological information as defined in claim 1 wherein:

said first display means is a ring-shaped member capable of rotating around said center axis;

said second display means is a member fixed on a watch dial;

said auxiliary setting means comprises a moon direction instruction means which rotates in a period substantially equal to that of a diural motion of the moon, and a sun direction instruction means which rotates in a period substantially equal to that of a diurnal motion of the sun;

when by rotating said first display means, the present sun direction of said first display means is set to the direction of said sun direction instruction means, an aspect is read from the display information of the second display means corresponding to a direction of the sun on the birthday among all the display information of the first dispaly means at that time; and furthermore, when by rotating said first display means, a moon direction of said first display means corresponding to the direction of said moon direction instruction means is set to an origin of the apsect display of said second display means, a person's aspect or a fortune corresponding to said aspect is read from the display on the second display means corresponding to the sun direction on the birthday of the first display means.

3. The apparatus for displaying astrological information as defined in claim 1 wherein:

said second display means is adapted to rotate around the same center axis as that of the first display means by said auxiliary setting means, said second display means rotating in a period of that of one tropical month, that is 27.3216 days, relatively to said first display means;

at a position corresponding to the sun direction information of said second display means, a moon's age origin mark, moon's age marks, equally spaced starting from said origin mark, said aspect and fortune characters are displayed; and when by rotating said second display means, a mark representing a certain date, that is, set date on said first display means, is set to the moon's age mark representing the moon's age on said date on said second display means, an angle between the direction of the moon's age origin mark and the direction of the birthday of said first display means gives said aspect, and the information on said second dispaly means corresponding to said birthday of said first dispaly means provides a direct indication of a person's aspect or a fortune corresponding to said aspect.

4. The apparatus for displaying astrological information as defined in claim 1 wherein:

said first display means is a ring-shaped member capable of rotating around the center axis;

said second display means is adapted to rotate around the same center axis as that of aid first display means in a period of a mean waxing and waning period, that is, 29.53 days;

at a position corresponding to the sun direction information of said first display means on said second display means, a moon's age origin mark and fortune characters starting from said origin mark are displayed;

said apparatus for displaying astrological information further comprises moon age's marks fixed on said watch dial at regular intervals around the same center axis as that of the first and second display means; and when by rotating said second display means, the moon age's origin mark is set to the moon's age mark corresponding to the moon's age of a certain date, that is, set date,m and then by rotating said first display means, the today's sun direction of said first display means is set to the moon's age origin mark of said second display means, fortune characters of said display means corresponding to the sun direction on the birthday of said first display means provides a direct indication of a person's aspect or a fortune corresponding to said aspect.

* * * * *